US010154720B2

(12) United States Patent
Yeung et al.

(10) Patent No.: US 10,154,720 B2
(45) Date of Patent: Dec. 18, 2018

(54) DUAL END COSMETIC CONTAINER

(71) Applicant: Crystal International (Group), Inc., East York (CA)

(72) Inventors: Ting-Hin Yeung, Markham (CA); Roger Ting Chih Hwang, Maple (CA); Yuen Han Chow, Scarborough (CA); Wen Wendy Tung, Scarborough (CA)

(73) Assignee: CRYSTAL INTERNATIONAL (GROUP), INC., East York (CA)

( * ) Notice: Subject to any disclaimer, the term of this patent is extended or adjusted under 35 U.S.C. 154(b) by 212 days.

(21) Appl. No.: 15/201,980

(22) Filed: Jul. 5, 2016

(65) Prior Publication Data

US 2018/0008027 A1 Jan. 11, 2018

(51) Int. Cl.

| | |
|---|---|
| ***B43K 27/02*** | (2006.01) |
| ***A45D 40/24*** | (2006.01) |
| ***A45D 40/04*** | (2006.01) |
| ***A45D 40/18*** | (2006.01) |
| ***A45D 40/06*** | (2006.01) |
| ***A45D 40/20*** | (2006.01) |

(52) U.S. Cl.

CPC ..... *A45D 40/24* (2013.01); *A45D 40/04* (2013.01); *A45D 40/06* (2013.01); *A45D 40/065* (2013.01); *A45D 40/18* (2013.01); *A45D 40/205* (2013.01); *A45D 2040/208* (2013.01)

(58) Field of Classification Search

CPC ..... A45D 40/18; A45D 40/24; A45D 40/04; A45D 40/06; A45D 40/065; A45D 40/205; A45D 2040/208

USPC ..... 401/19

See application file for complete search history.

(56) References Cited

U.S. PATENT DOCUMENTS

| | | | | |
|---|---|---|---|---|
| 6,773,184 | B2 | 8/2004 | An | |
| 8,444,334 | B2 | 5/2013 | Cardia | |
| 8,662,775 | B1 | 3/2014 | Liu | |
| 8,662,776 | B2 | 3/2014 | Porter et al. | |
| 8,967,896 | B2 | 3/2015 | Johnson et al. | |
| 9,095,199 | B2 | 8/2015 | Chen | |
| 9,549,604 | B2 * | 1/2017 | Liu | A45D 40/24 |
| 2015/0250290 | A1 | 9/2015 | Holloway | |

FOREIGN PATENT DOCUMENTS

| | | | |
|---|---|---|---|
| DE | 3923731 | A1 | 1/1991 |
| EP | 2074903 | A1 | 7/2009 |
| KR | 20120046859 | A | 5/2012 |
| WO | 2011/131794 | A1 | 10/2011 |

* cited by examiner

*Primary Examiner* — Jennifer C Chiang

(74) *Attorney, Agent, or Firm* — Patterson + Sheridan, LLP

(57) ABSTRACT

A dual end container for products such as cosmetic products or applicators is provided. More specifically, a dual end container with a compact, integrated mechanism for selectively extending and retracting a first product or applicator without movement of a second product or applicator is disclosed. The dual end container includes a first cup, a second cup, which is at least partially housed within the first cup, and a driving member between the first cup and the second cup. The first cup has a first male thread, the second cup has a second male thread and the driving member has a first and second female thread. The first male thread interacts with the first female thread to extend and retract the first cup. The second male thread interacts with the second female thread to extend and retract the second cup.

22 Claims, 6 Drawing Sheets

DUAL END COSMETIC CONTAINER

BACKGROUND OF THE INVENTION

Field of the Invention

The present invention generally relates to a dual end container for applying personal products, such as cosmetic products. More specifically, a dual end container with a compact, integrated mechanism for selectively extending and retracting a first product without movement of a second product is disclosed.

Description of the Related Art

The cosmetics industry is a large industry and provides consumers with a myriad of products. Many consumers use multiple cosmetic products throughout the day. Accordingly, these consumers carry their preferred products in their personal items, such as a handbag. Typically, each individual product is housed in its own container, though there are some containers which house two or more cosmetic products.

However, traditional dual cosmetic containers are bulky because they require two distinct mechanisms, each of which takes up a lot of space in the container.

Therefore, there is a need for an improved dual end container.

SUMMARY OF THE INVENTION

In one example, a dual end container includes a first cup configured to contain a first product or product applicator, a second cup configured to contain a second product or a product applicator, and a driving member positioned between the first cup and the second cup. The first and second cups are facing in opposite directions and are aligned along a longitudinal axis of the dual end container. The driving member includes a first threaded member coupled to the first cup, the first threaded member having an interior volume and a second threaded member coupled to the second cup and at least partially disposed within the interior volume of the first threaded member.

In another example, a dual end container includes a driving member having a longitudinally oriented opening formed therein with a first female thread and a second female thread formed in the opening. The dual end container also includes a first cup coupled to a first side of the driving member and a second cup coupled to a second side of the driving member. The first cup has an interior volume and an outer surface with a first male thread formed thereon. The second cup has an outer surface with a second male thread formed thereon. A diameter of the outer surface of the second cup is less than a diameter of the interior volume of the first cup and the second cup is at least partially housed within the interior volume of the first cup.

In yet another example, a dual end container includes a hollow driving member, a first cup, a second cup, a first shell disposed over the first cup, a second shell disposed over the second cup, a first cap, and a second cap. The driving member includes a first female thread and a second female thread. The first cup has a first male thread that interfaces with the first female thread. The second cup has a second male thread that interfaces with the second female thread. The first cup receives at least a portion of the second cup along a longitudinal axis of the driving member. The first cap is sized to tightly couple with the first shell. The second cap is sized to loosely couple with the second shell.

In summation, the present invention generally relates to a dual end container for products such as cosmetic products. More specifically, a dual end container with a compact, integrated mechanism for selectively extending and retracting a first product or product applicator without movement of a second product or product applicator is disclosed. The dual end container includes a first cup, a second cup, which is at least partially housed within the first cup, and a driving member between the first cup and the second cup. The first cup has a first male thread, the second cup has a second male thread and the driving member has a first and second female thread. The first male thread interacts with the first female thread to extend and retract the first cup. The second male thread interacts with the second female thread to extend and retract the second cup.

BRIEF DESCRIPTION OF THE DRAWINGS

So that the manner in which the above recited features of the present invention can be understood in detail, a more particular description of the invention, briefly summarized above, may be had by reference to examples, some of which are illustrated in the appended drawings. It is to be noted, however, that the appended drawings illustrate only typical examples of this invention and are therefore not to be considered limiting of its scope, for the invention may admit to other equally effective examples.

To facilitate understanding, identical reference numerals have been used, where possible, to designate identical elements that are common to the figures. It is contemplated that elements and features of one example may be beneficially incorporated in other example without further recitation.

DETAILED DESCRIPTION

The present invention generally relates to a dual end container for applying personal products, such as cosmetic products. The dual end container has a compact, integrated mechanism for selectively extending and retracting a first product or a first applicator from one end of the container without movement of a second product or a second applicator disposed at an opposite end of the container and vice versa. The dual end container includes a first cup, a second cup and a driving member disposed between the first cup and the second cup. The first cup has a first male thread, the second cup has a second male thread and the driving member has a first and second female thread. The first male thread interacts with the first female thread to extend and retract the first cup without movement of the second cup. The second male thread interacts with the second female thread to extend and retract the second cup without movement of the first cup. This selective extension enables the consumer to select the product or the applicator to be used and only advance that product or applicator without unnecessarily extending the other product or applicator.

Figure 1A:
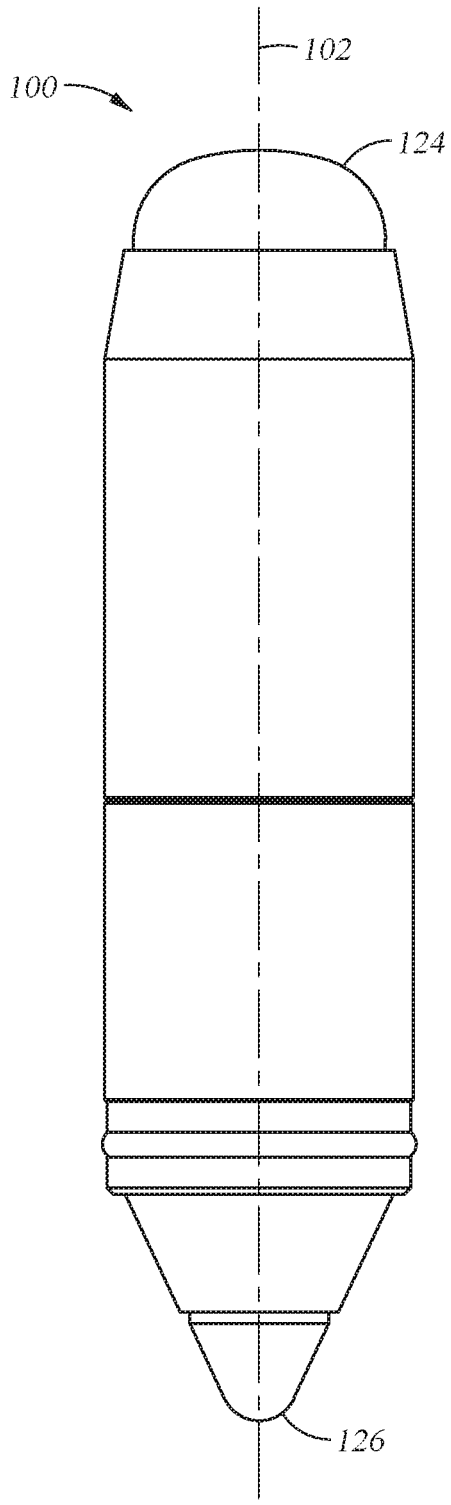
FIG. 1A is a front view of a dual end container according to one example.

FIG. 1A is a front view of a dual end container 100 according to one example. The dual end container 100 is configured to house a first product 124 and a second product 126. The dual end container 100 has a longitudinal axis 102.

Figure 1B:
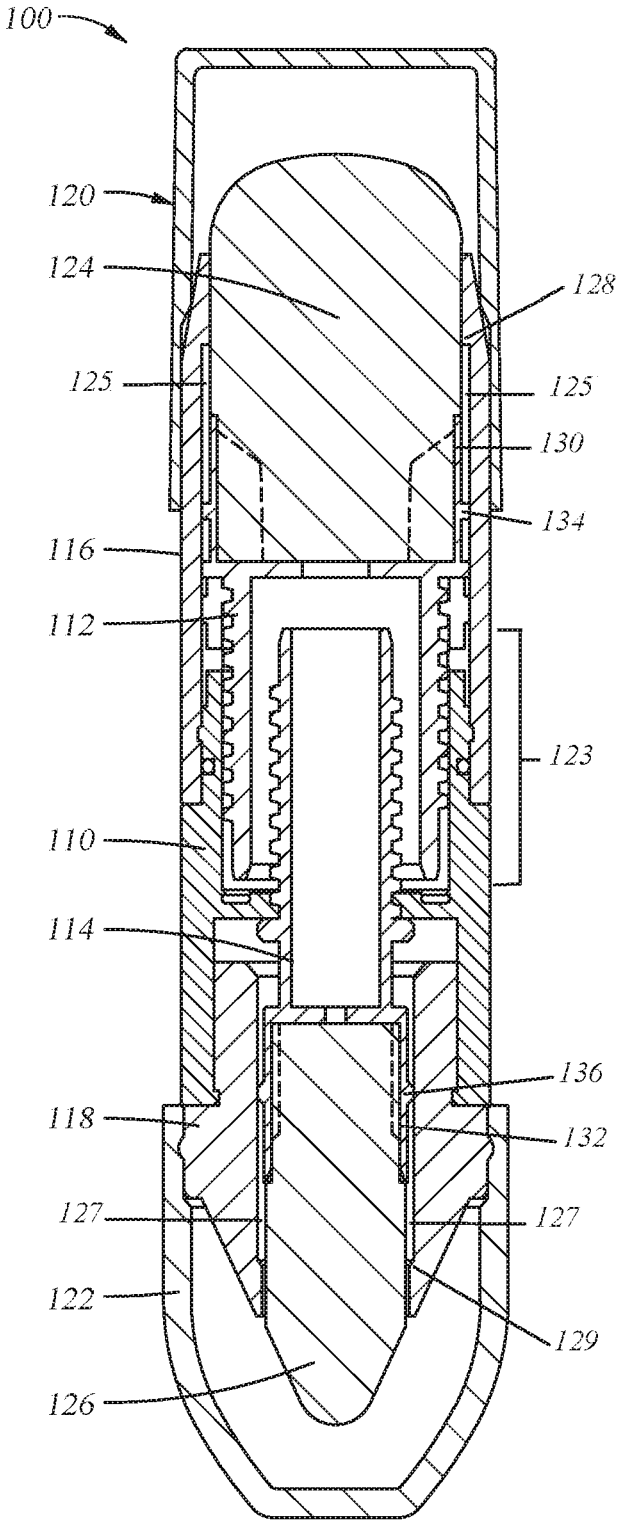
FIG. 1B is a schematic cross-sectional view of the dual end container of FIG. 1A.

FIG. 1B is a schematic cross-sectional view of the dual end container 100 of FIG. 1A. The dual end container 100 includes a driving member 110, which is located between a first cup 112 and a second cup 114 along the longitudinal axis 102. A first shell 116 surrounds the first cup 112 and a second shell 118 surrounds the second cup 114. A first cap 120 couples with the first shell 116 and a second cap 122 couples with the second shell 118. The first cup 112 is configured to contain the first product 124 and the second cup 114 is configured to contain the second product 126. For example, the first cup 112 may include a product container portion 130 for holding the first product 124. Likewise, the second cup 114 may include a product container portion 132 for holding the second product 126.

The dual end container 100 includes a threaded region 123 that moves one or both of the first cup 112 and the second cup 114 along the longitudinal axis 102 when relative movement is provided between the driving member 110 and the first cup 112 or the second cup 114. The first cup 112 is adapted to move along the longitudinal axis 102 in an enlarged internal region 125 of the first shell 116. Likewise, the second cup 114 is adapted to move along the longitudinal axis 102 in an enlarged internal region 127 of the second shell 118. The first shell 116 may include a stop mechanism such as a first stop 128 that interacts with a shoulder 134 that extends radially outward from the product container portion 130. When the first cup 112 is moved along the longitudinal axis 102 away from the driving member 110, the shoulder 134 contacts the first stop 128 to prevent additional movement of the first cup 112 along the longitudinal axis 102. Likewise, the second shell 118 may include a stop mechanism such as a second stop 129 that interacts with a shoulder 136 that extends radially outward from the product container portion 132. When the second cup 114 is moved along the longitudinal axis 102 away from the driving member 110, the shoulder 136 contacts the second stop 129 to prevent additional movement of the second cup 114 along the longitudinal axis 102.

Figure 2A:
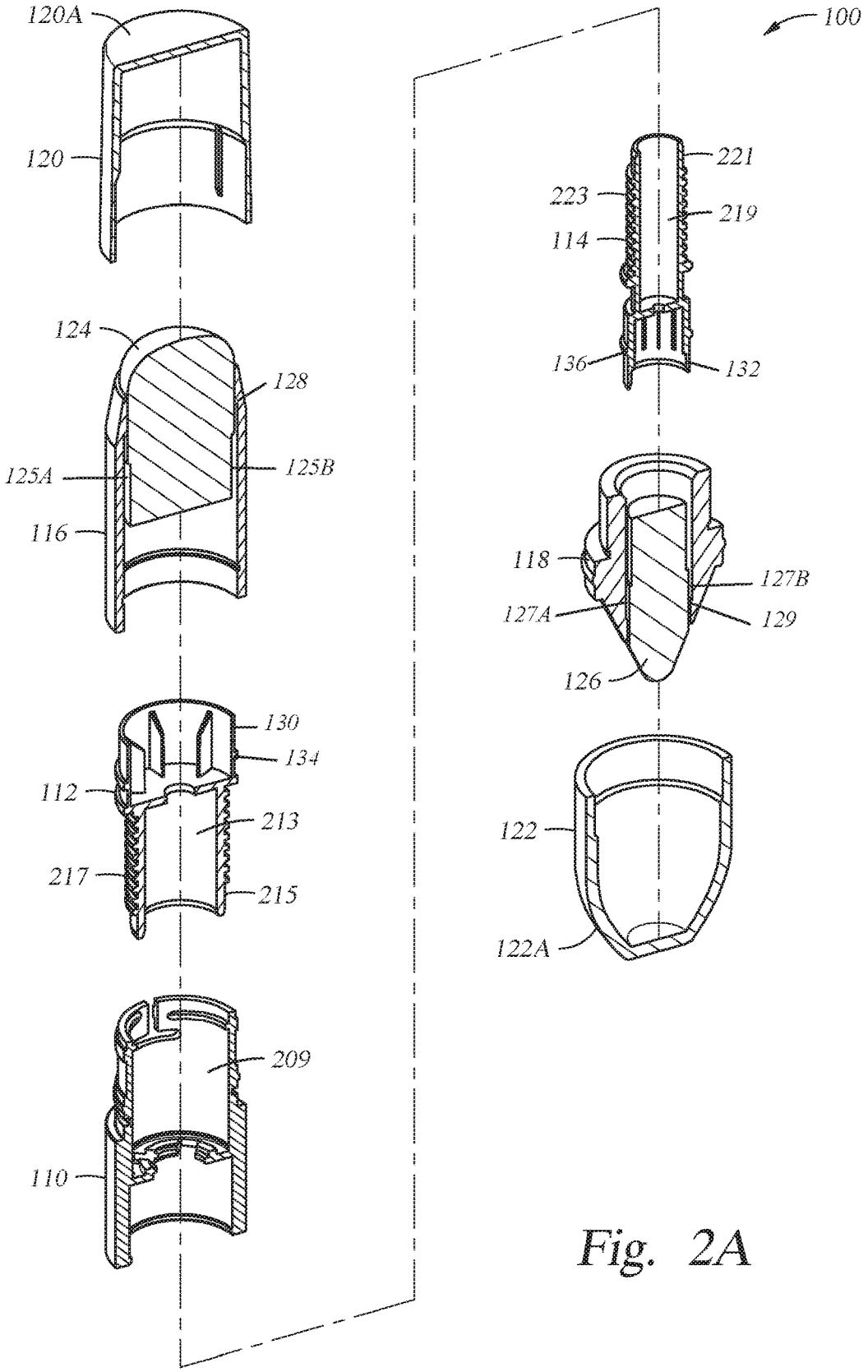
FIG. 2A is an exploded cross-sectional view of the dual end container of FIG. 1B.
Figure 2B:
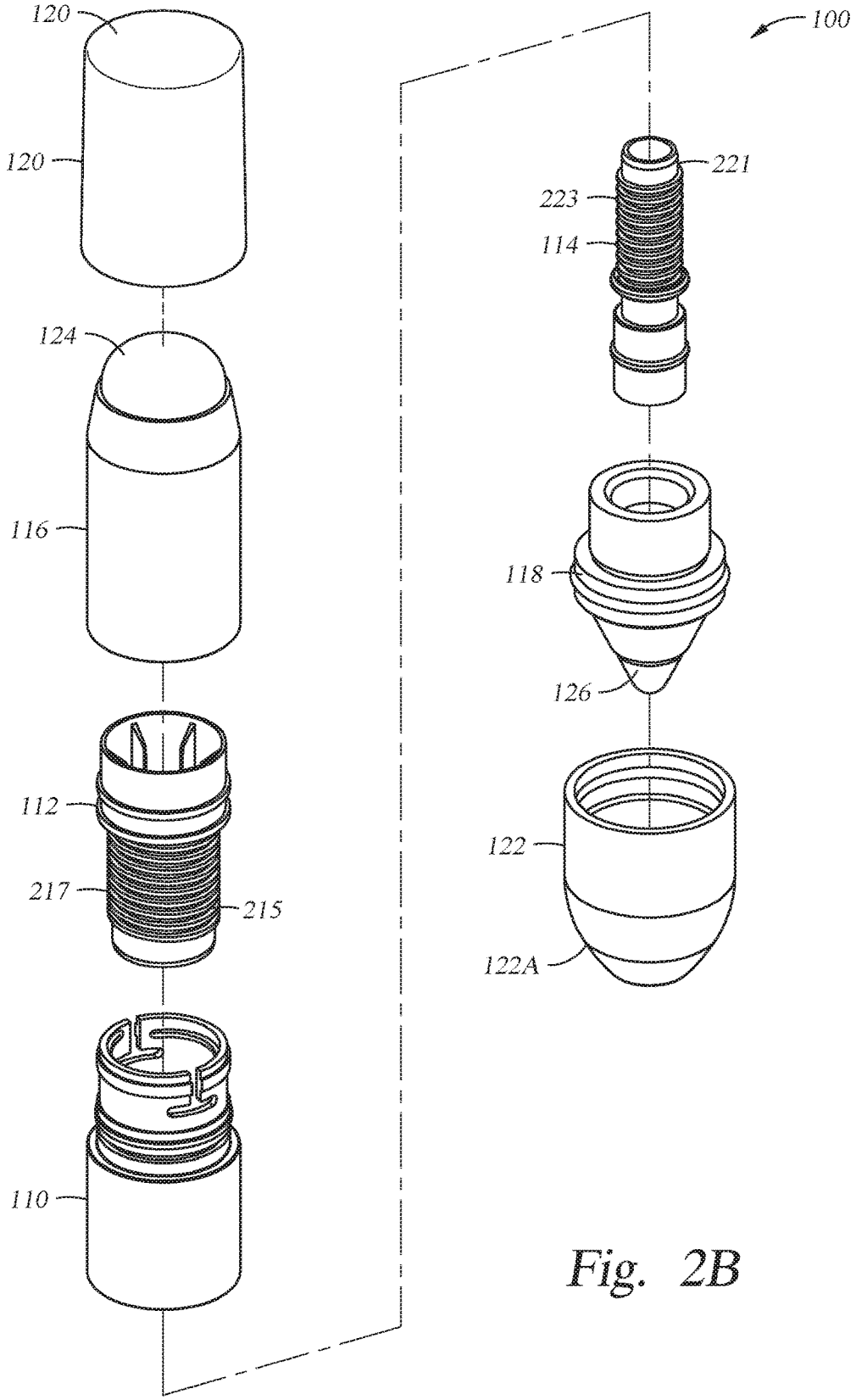
FIG. 2B is an exploded isometric view of the dual end container of FIG. 1B.
Figure 2C:
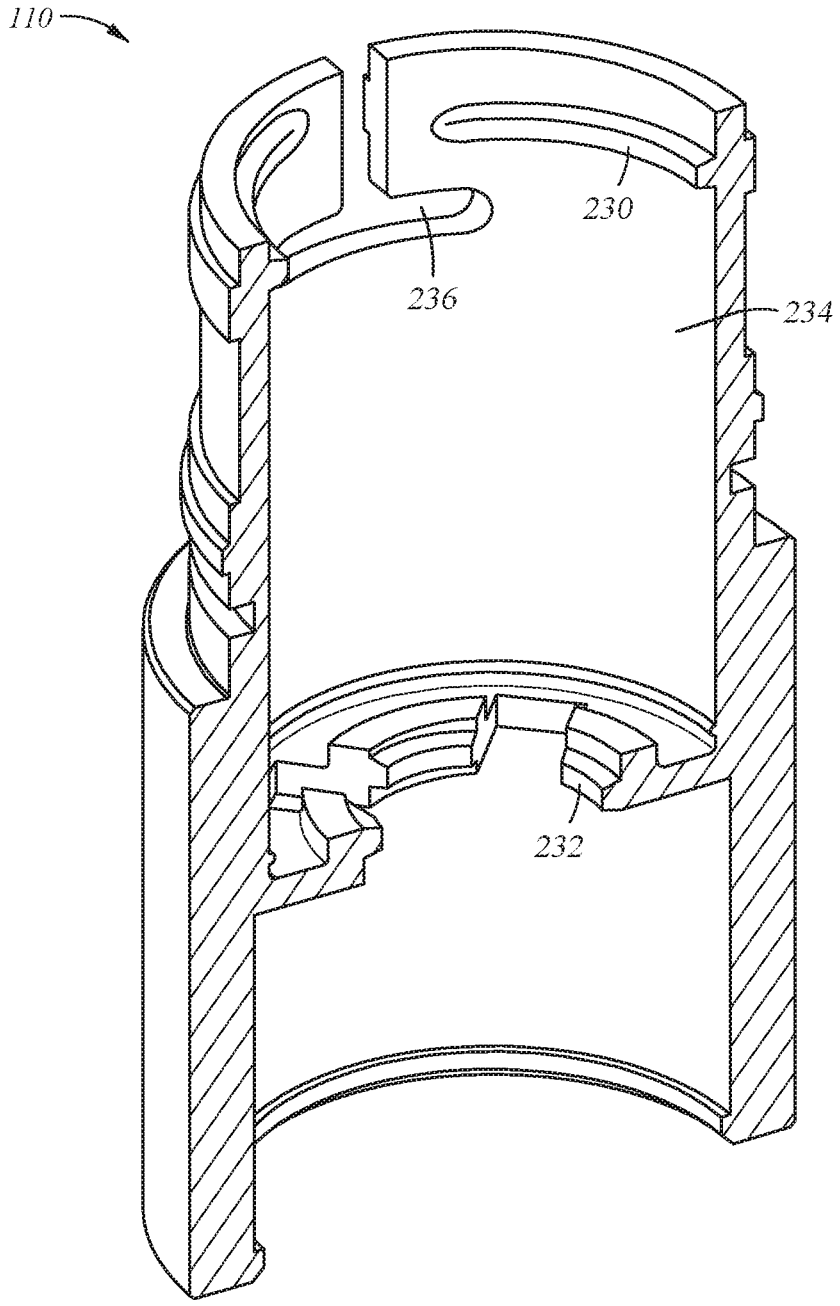
FIG. 2C is an enlarged cross-sectional view of the driving member shown in FIG. 2A.

FIG. 2A is an exploded cross-sectional view of the dual end container 100 of FIG. 1B. FIG. 2B is an exploded isometric view of the dual end container 100 of FIG. 1B. FIG. 2C is an enlarged cross-sectional view of the driving member 110. As shown in FIGS. 2A-2C, the driving member 110 is a hollow body enclosing an interior volume 234 and has a groove/cut out 236 towards proximal end. Further, the driving member 110 has a first female thread 230 near proximal portion or first side and a second female thread 232 near distal portion or second side. A portion of first cup 112 is received in the interior volume 234 in the proximal portion of the driving member and a portion of the second cup 114 is received in the interior volume 234 in the distal portion of the driving member 110. As shown in FIGS. 2A-2B, the first cup 112 has an interior volume 213 and an outer surface 215 with a first male thread 217 formed thereon. The second cup 114 has an interior volume 219 and an outer surface 221 with a second male thread 223 formed thereon. A diameter of the outer surface 221 is less than a diameter of the interior volume 213 such that the second cup 114 is at least partially housed within the interior volume 213 of the first cup 112. The first female thread 230 engages with first male thread 217 and the second female thread 232 engages with second male thread 223.

The first male thread 217 and the second male thread 223 may be right-handed threads, the first male thread 217 and the second male thread 223 may be left-handed threads, the first male thread 217 may be a right-handed thread and the second male thread 223 may be a left-handed thread, or the first male thread 217 may be a left-handed thread and the second male thread 223 may be a right-handed thread.

Each of the driving member 110, the first cup 112, the second cup 114, the first shell 116, the second shell 118, the first cap 120, and the second cap 122 may be made of plastic, or any other suitable material. In one example, the first product 124 and the second product 126 may be a cosmetic product, such as lipstick, lip gloss, foundation, mascara, eye liner, eye shadow, or cheek color. Additionally, one or both of the first product 124 and the second product 126 may be replaced with cosmetic applicators, such as a sponge or a brush. In another example, the first product 124 and the second product 126 may be personal care products, such as deodorant. In yet another example, one or both of the first product 124 and the second product 126 may be skincare products. In even further examples, the first product 124 and the second product 126 may be hair products or pet products.

The first cap 120 and the second cap 122 are removable from the first shell 116 and the second shell 118, respectively. As shown in FIGS. 2A and 2B, the first cap 120 has a top surface 120A that is flat, whereas the second cap 122 has a top surface 122A that is tapered. According to other alternate embodiments, the first cap 120 and the second cap 122 may have other desired shapes. The first cap 120 may be sized to removeably snap fit to or interference fit with the first shell 116. The second cap 122 may be sized to loosely cover the second shell 118. Because the second cap 122 loosely covers the second shell 118, the second cup 114, and thus the second product 126, cannot be accidentally actuated while the second cap 122 is still on. In order for the second product 126 to be actuated and translated along the longitudinal axis 102 of the dual end container 100, the consumer must purposefully remove the second cap 122.

The driving member 110 is engaged with the first shell 116 and the second shell 118 such that the driving member 110 is rotatable relative to the first shell 116 and the second shell 118, respectively. In operation, when the first shell 116 is rotated relative to the driving member 110 and the first cup 112 is rotationally constrained relative to the first shell 116, the first cup 112 moves axially along the longitudinal axis 102 of the dual end container 100. Alternatively, when the driving member 110 is rotated relative to the first shell 116 and the first cup 112 is rotationally constrained relative to the first shell 116, the first cup 112 moves axially along the longitudinal axis 102 of the dual end container 100. More specifically, rotating the first shell 116 or the driving member 110 results in interfacing of the first male thread 217 with the first threaded member 230. Rotating the first shell 116 or the driving member 110 in a first direction, for example to the left side of the page as shown in the Figs., extends the first cup 112 and the first product 124 longitudinally out of the dual end container 100, whereas rotating the first shell 116 or the driving member 110 in a second direction, for example to the right side of the page as shown in the Figs., retracts the first cup 112 and the first product 124 longitudinally into the dual end container 100.

Similarly, when the second shell 118 is rotated relative to the driving member 110 and the second cup 114 is rotationally constrained relative to the second shell 118, the second cup 114 moves axially along the longitudinal axis 102 of the dual end container 100. Alternatively, when the driving member 110 is rotated relative to the second shell 118 and the second cup 114 is rotationally constrained relative to the second shell 118, the second cup 114 moves axially along the longitudinal axis 102 of the dual end container 100. Rotating the second shell 118 or the driving member 110 results in interfacing of the second male thread 223 with the second threaded member 232. Rotating the second shell 118 or the driving member 110 in a first direction, for example clockwise (to the left side of the page as shown in the Figs.), extends the second cup 114 and the second product 126 longitudinally out of the dual end container 100, whereas rotating the second shell 118 or the driving member 110 in a second direction, for example counterclockwise (to the right side of the page as shown in the Figs.), retracts the second cup 114 and the second product 126 longitudinally into the dual end container 100.

One or more of the first stop 128, the second stop 129 and the groove 236 may prevent disassembling of the parts of the dual end container 100. When the first cup 112 is extended by rotation of the first shell 116 relative to the driving member 110, the first cup 112 may be prevented from overextending from the dual end container 100 by the first stop 128 of the first shell 116. The first stop 128 is an inwardly extending protrusion of the first shell 116, which the first cup 112 cannot pass. Similarly, the second cup 114 may be prevented from overextending from the dual end container 100 by the second stop 129 of the second shell 118. The second stop 129 is an inwardly extending protrusion of the second shell 119, which the second cup 114 cannot pass. Additionally, the groove 236, shown in FIG. 2C, weakens the reacting force of the first threaded member 230. In other words, the groove 236 prevents the first cup 112 from forcing the first shell 116 and the driving member 110 apart.

Figure 3:
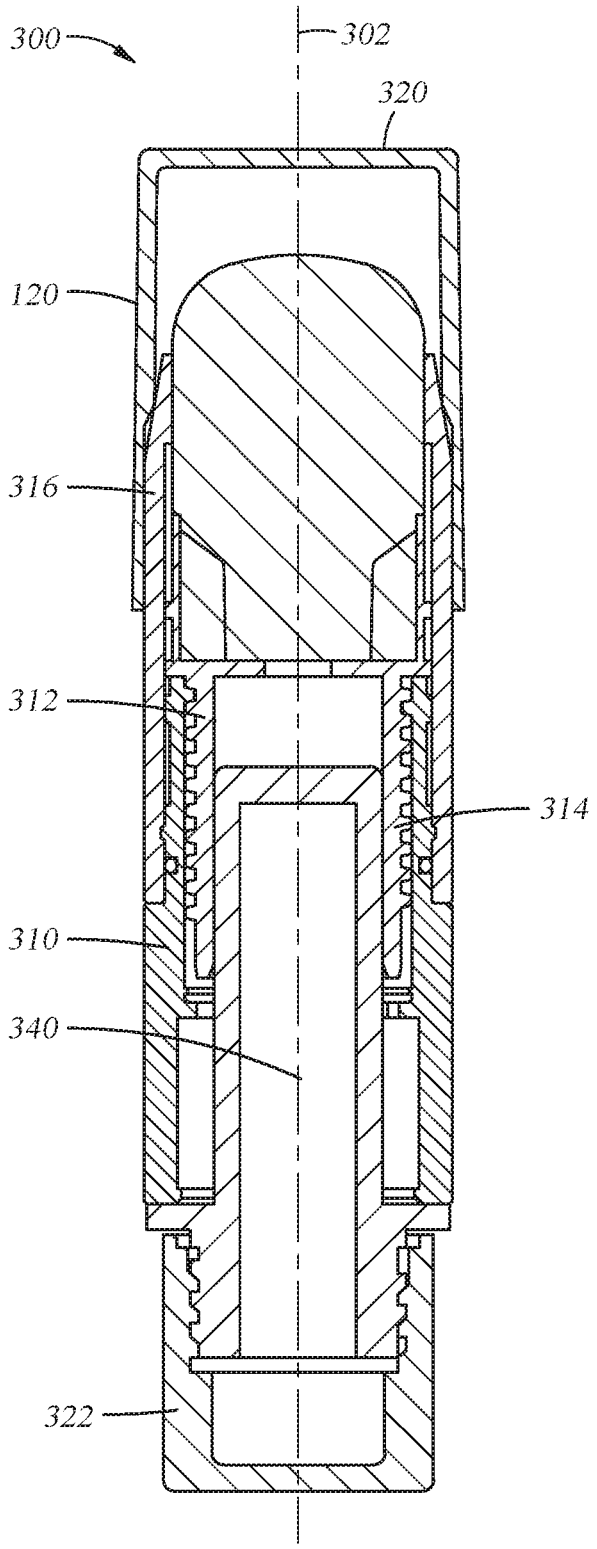
FIG. 3 is a schematic cross-sectional view of a dual end container according to another example.

FIG. 3 is a schematic cross-sectional view of a dual end container 300 according to another example. The dual end container 300 is similar to the dual end container 100 except that the second cup is replaced by a vial 340. As shown in FIG. 3, the first cup 312 holds the vial 340. The vial 340 may contain a second product. For example, the vial 340 may contain a lip gloss, a perfume, a skin care solution, a dental solution, a pet care solution, or other product. Alternatively, the second cup 314 may be configured to hold a cartridge for dispensing a product. The vial 340, or alternatively the cartridge, may be plastic, glass, or any other suitable material.

In operation, when the first shell 316 is rotated relative to the driving member 310 and the first cup 312 is rotationally constrained relative to the first shell 316, the first cup 312 moves axially along the longitudinal axis 302 of the dual end container 300. Alternatively, when the driving member 310 is rotated relative to the first shell 316 and the first cup 312 is rotationally constrained relative to the first shell 316, the first cup 312 moves axially along the longitudinal axis 302 of the dual end container 300. In this example, the vial 340 does not move axially along the longitudinal axis 302 of the dual end container 310. Instead, the vial 340 remains stationary in the dual end container 300 and the consumer may remove the second cap 322, which is disposed over the vial 340, to access the product contained within the vial 340.

Figure 4:
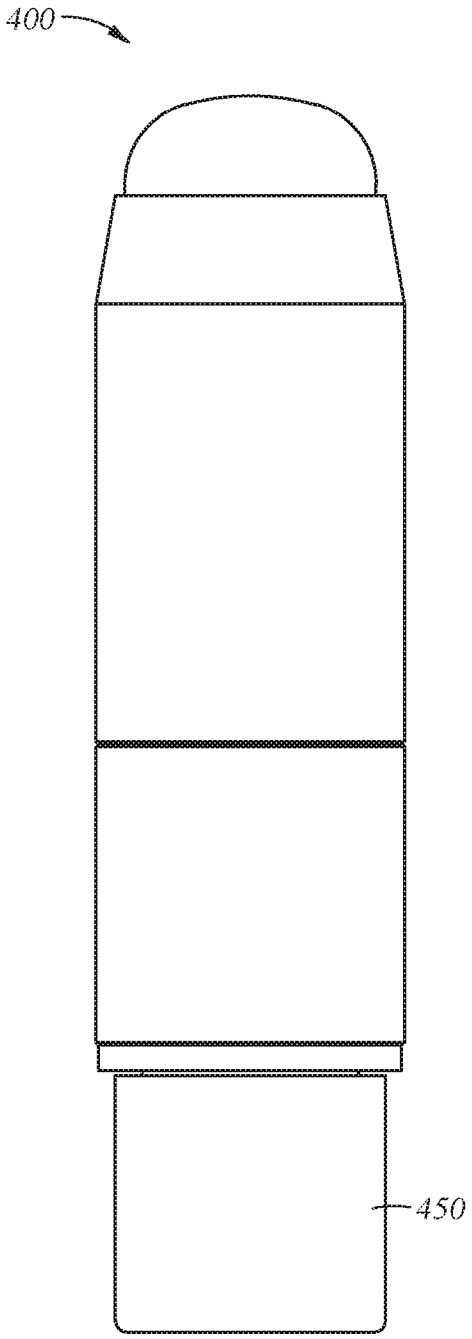
FIG. 4 is a front view of a dual end container according to yet another example.

FIG. 4 is a front view of a dual end container 400 according to yet another example. The dual end container 400 is similar to the dual end container 100 except that the second cup is configured to hold an applicator 450. Examples of applicator 450 include a sponge, a brush, a spatula, a flocked tip, a non-flocked tip among others.

While the above described examples contemplate disposing the first threaded member 230 and the second threaded member 232 on the driving member 110, in yet another example, the first threaded member 230 and the second threaded member 232 could be disposed in the first shell 116 and the second shell 118, respectively. Disposing the first threaded member 230 in the first shell 116 and the second threaded member 232 in the second shell 118 may result in a more integrated mechanism, which may further shorten the length of the dual end container 100.

Figure 5:
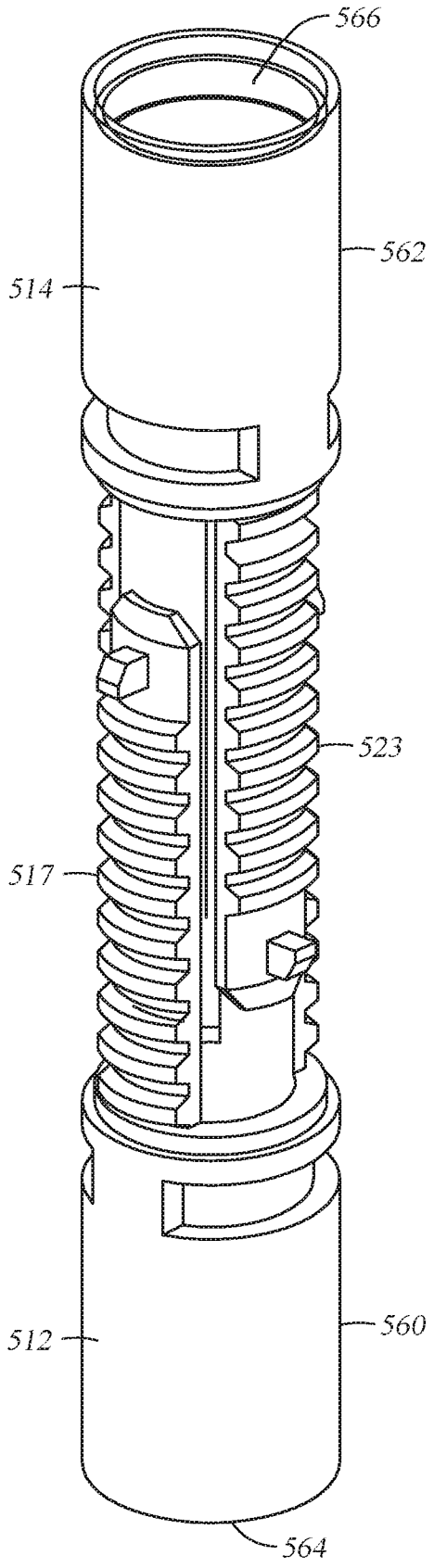
FIG. 5 is a perspective view of a first cup and a second cup of a dual end container according to yet another example.

FIG. 5 is a perspective view of another embodiment of a first cup 512 and a second cup 514 which may be used in the dual end container 100 according to yet another example. The first cup 512 has an interior volume 564 and an outer surface 560 with a first male thread 517 formed thereon. The second cup 514 has an interior volume 566 and an outer surface 562 with a second male thread 523 formed thereon. In one example, the first male thread 517 and the second male thread 523 are interleaved. The diameter of the outer surface 560 of the first cup 512 and the diameter of the outer surface 562 of the second cup 514 are equal. The interior volume 564 of the first cup 512 and the interior volume 566 of the second cup 514 may also be equal.

In operation, the first male thread 517 of the first cup 512 interacts with the first threaded member of the driving member 110 (not shown), which may be modified to operate with the configuration of the first cup 512 and the second cup 514, and the second male thread 523 interacts with the second threaded member of the driving member 110. When the first shell 116, which may be modified to accommodate the configuration of the first cup 512, is rotated relative to the driving member 110 and the first cup 512 is rotationally constrained relative to the first shell 116, the first cup 512 moves axially along the longitudinal axis 102 of the dual end container 100. Alternatively, when the driving member 110 is rotated relative to the first shell 116 and the first cup 512 is rotationally constrained relative to the first shell 116, the first cup 512 moves axially along the longitudinal axis 102 of the dual end container 100. More specifically, rotating the first shell 116 or the driving member 110 results in interfacing of the first male thread 517 with the first threaded member, 230. In one example, the first threaded member 230 may be a first female thread. Rotating the first shell 116 or the driving member 110 in a first direction extends the first cup 512 and the first product 124 longitudinally out of the dual end container 100, whereas rotating the first shell 116 or the driving member 110 in a second direction retracts the first cup 512 and the first product 124 longitudinally into the dual end container 100.

Similarly, when the second shell 118, which may be modified to accommodate configuration of the second cup 514, is rotated relative to the driving member 110 and the second cup 514 is rotationally constrained relative to the second shell 118, the second cup 514 moves axially along the longitudinal axis 102 of the dual end container 100. Alternatively, when the driving member 110 is rotated relative to the second shell 118 and the second cup 514 is rotationally constrained relative to the second shell 118, the second cup 514 moves axially along the longitudinal axis 102 of the dual end container 100. Rotating the second shell 118 or the driving member 110 results in interfacing of the second male thread 523 with the second threaded member 232, which may be modified to accommodate the configuration of the second cup 514. Rotating the second shell 118 or the driving member 110 in a first direction extends the second cup 514 and the second product 126 longitudinally out of the dual end container 100, whereas rotating the second shell 118 or the driving member 110 in a second direction retracts the second cup 514 and the second product 126 longitudinally into the dual end container 100.

It is a benefit of the present disclosure that the overall length of the dual end cosmetic container is reduced due to use of the integrated mechanism in which the second cup is partially housed within the first cup. In other words, the present disclosure makes use of the space that is necessary for a single extension and retraction mechanism by fitting a second extension and retraction mechanism therein. These integrated mechanisms allow for extension and retraction of two cosmetic products out of opposite ends of the container independently of one another. It is another benefit of the present disclosure that the mechanisms described herein are designed to prevent accidental actuating of the cosmetic products. More specifically, the only shell, and thus product, which will be actuated and extended or retracted along the length of the container is the product desired by the consumer.

While the foregoing is directed to examples of the present invention, other and further examples of the invention may be devised without departing from the basic scope thereof, and the scope thereof is determined by the claims that follow.

The invention claimed is:

1. A dual end container comprising:

a first cup;

a second cup, the first and second cups facing in opposite directions and aligned along a longitudinal axis of the dual end container, an interior volume of the first cup and an interior volume of the second cup being fluidly connected through a passage extending between the first cup and the second cup; and a driving member positioned between the first cup and the second cup, wherein the driving member comprises:

a first threaded member coupled to the first cup, the first threaded member having an interior volume; and a second threaded member coupled to the second cup and at least partially disposed within the interior volume of the first threaded member.

2. The dual end container of claim 1, wherein the first threaded member is a first female thread.

3. The dual end container of claim 1, wherein the second threaded member is a second female thread.

4. The dual end container of claim 1 further comprising:

a first shell disposed over the first cup; and a second shell disposed over the second cup.

5. The dual end container of claim 4 further comprising:

a first cap disposed over the first shell; and a second cap disposed over the second shell.

6. The dual end container of claim 5, wherein the first cup is configured to contain a first product or applicator, and wherein the second cup is configured to contain a second product or applicator.

7. The dual end container of claim 5, wherein the first cup is moveable along the longitudinal axis of the dual end container when the first shell is rotated and the driving member is restrained.

8. The dual end container of claim 5, wherein the first cup is moveable along the longitudinal axis of the dual end container when the first shell is restrained and the driving member is rotated.

9. The dual end cosmetic container of claim 1, wherein the passage is centrally located along the longitudinal axis of the dual end cosmetic container.

10. The dual end cosmetic container of claim 9, wherein the first cup has a first opening formed therethrough, wherein the second cup has a second opening formed therethrough, and wherein the passage extends from the first opening of the first cup to the second opening of the second cup.

11. A dual end container comprising:

a driving member having an interior volume formed therein with a first female thread and a second female thread formed in the interior volume;

a first cup coupled to a first side of the driving member, the first cup having an interior volume and an outer surface with a first male thread formed thereon; and a second cup coupled to a second side of the driving member, the second cup having an outer surface with a second male thread formed thereon, wherein a diameter of the outer surface of the second cup is less than a diameter of the interior volume of the first cup and the second cup is at least partially housed within the interior volume of the first cup.

12. The dual end container of claim 11, wherein the first male thread interfaces with the first female thread, and wherein the second male thread interfaces with the second female thread.

13. The dual end container of claim 11 further comprising:

a first product, wherein the first product is coupled to the first cup; and a second product, wherein the second product is coupled to the second cup.

14. The dual end container of claim 13, wherein the first product and the second product are products selected from a group consisting of cosmetic products, skincare products, dental products, personal care products, cosmetic applicators and pet products.

15. The dual end container of claim 13, wherein the first product or the second product is a cartridge, wherein the cartridge dispenses a cosmetic product.

16. The dual end container of claim 13, wherein the first cup or the second cup is a vial, wherein the vial contains a cosmetic product.

17. A dual end container comprising:

a hollow driving member, wherein the driving member comprises:

a first female thread; and a second female thread;

a first cup, the first cup having a first male thread that interfaces with the first female thread;

a second cup, the second cup having a second male thread that interfaces with the second female thread, and wherein the first cup receives at least a portion of the second cup along a longitudinal axis of the driving member;

a first shell disposed over the first cup;

a second shell disposed over the second cup;

a first cap, wherein the first cap is sized to tightly couple with the first shell; and a second cap, wherein the second cap is sized to loosely couple with the second shell.

18. The dual end container of claim 17, wherein the first cup is configured to contain a first product and the second cup is configured to contain a second product.

19. The dual end container of claim 18, wherein the first product and the second product are cosmetic products.

20. The dual end container of claim 18, wherein the first product and the second product are skincare products.

21. The dual end container of claim 18, wherein the first cup or the second cup is a vial.

22. The dual end container of claim 18, wherein the first product or the second product is a cosmetic applicator.

* * * * *